United States Patent [19]

Machida et al.

[11] 3,933,667

[45] Jan. 20, 1976

[54] DOUBLE DISPERSION ACRYLATE OR METHACRYLATE WET DEVELOPER

[75] Inventors: Hazime Machida; Zenjiro Okuno, both of Tokyo, Japan

[73] Assignee: Kabushiki Kaisha Ricoh, Tokyo, Japan

[22] Filed: Mar. 12, 1973

[21] Appl. No.: 340,111

[30] Foreign Application Priority Data

Mar. 11, 1972 Japan ..... 47-24986

[52] U.S. Cl. ..... 252/62.1 L

[51] Int. Cl.[2] ..... G03G 9/00

[58] Field of Search ..... 252/62.1 L

[56] References Cited

UNITED STATES PATENTS

| | | | |
|---|---|---|---|
| 3,671,646 | 6/1972 | Kurita et al. | 252/62.1 L |
| 3,716,360 | 2/1973 | Fukushima et al. | 252/62.1 L X |
| 3,717,461 | 2/1973 | Honjo | 252/62.1 L X |
| 3,729,418 | 4/1973 | Machida et al. | 252/62.1 L |
| 3,753,760 | 8/1973 | Kosel | 252/62.1 L X |

*Primary Examiner*—Samuel Feinberg
*Assistant Examiner*—Peter A. Nelson
*Attorney, Agent, or Firm*—Henry T. Burke

[57] ABSTRACT

A wet developer for use in electrophotography which consists of a carrier liquid having electric resistance of $10^9$ Ω. cm or more and dielectric constant of less than 3 and containing colored particles with a particle size of about 0.1 ~ 10 μ, said particles being substantially insoluble in said carrier liquid, possessed of properties of solid matter and showing a distinct polarity within said carrier liquid, coupled with adhesive suspended particles with a particle size of about 0.01 ~ 10 μ which show the same polarity as said colored particles.

7 Claims, No Drawings

DOUBLE DISPERSION ACRYLATE OR METHACRYLATE WET DEVELOPER

BACKGROUND OF THE INVENTION a. Field of the Invention

The present invention relates to a developer for use in electrostatic photography, and it particularly relates to a liquid developer for use in electrostatic photography which demonstrates a superb effect in transfer of image.

b. Description of the Prior Art

As the method of developing an electrostatic latent image formed on the electrophotographic copying material, electrostatic recording material, etc., there are generally known the dry-developing method and wet-developing method. Further, the developing method is classified into the transfer process and the direct process by the difference of the process for obtaining the final copies. Accordingly, it is theoretically possible to employ either the dry-developing method or wet-developing method for both the transfer process and direct process. The wet-developing method is superior to the dry-developing method in that it renders a copied image with less edge effect and a high resolving power. Meanwhile, the transfer process renders it possible to form a copied image on an ordinary paper film and other materials not provided with a photoconductive layer, so that it has an advantage that the resulting copies are easy to handle as compared with the case of the direct process.

However, the transfer process has hitherto employed the dry-developing method, and application of the wet-developing method to the transfer process has scarcely been tried. The main reason for this is as follows. According to the dry-developing method, inasmuch as the toner for dry process to serve as the developer is a dry powder and not possessed of tackiness, the image formed on the photoconductive layer is easy to transfer and the residual image on the photoconductive layer after transfer is also easy to remove, while, according to the wet-developing method, inasmuch as the developer for use therein is one prepared by dispersing the toner for wet process in an insulating carrier liquid, the toner image formed on the photoconductive layer is possessed of tackiness, so that transfer cannot be performed sufficiently and the residual image is hard to remove.

As the known developer for use in electrophotography, there is, for instance, a developer disclosed in Japanese patent publication No. 11069/1966. The toner employed for this developer has a comparatively good transferability, but as the electric charge of said toner is indistinct, the concentration of the image becomes insufficient, there is brought about a stained ground, and further the transferred toner is poor in fixability and unusable for wet-process transfer.

SUMMARY OF THE INVENTION

The object of the present invention is to provide a liquid developer for use in electrostatic photography which demonstrates a superb effect in wet-process image transfer. In other words, the object of the present invention is to provide a liquid developer for use in electrostatic photography which renders an easy and sufficient transfer of an image to a paper and other materials from a photoconductive layer on the occasion of transferring an image obtained by wet-developing method and makes the transferred image display an excellent fixability.

Such a liquid developer must satisy the conditions that (1) the toner can adhere to the electrostatic latent image sufficiently, (2) the toner adhering to the photoconductive layer can be easily transferred to a paper or other materials, (3) the toner remaining on the photoconductive layer after transfer can be easily removed, (4) the fixability of the transferred image is satisfactory, etc.

The inventors of the present invention have made a series of studies on how to satisfy these conditions, and, as a result, they have come to the finding that a developer having the following composition is suitable for this purpose. In other words, they have found that a developer consisting of a carrier liquid having electric resistance of $10^9$ Ω·cm or more and dielectric constant of less than 3 and containing colored particles (A) with a particle size of about 0.1 ~ 10 μ, said particles (A) being substantially insoluble in said carrier liquid, possessed of properties of solid matter and showing a distinct polarity within said carrier liquid, coupled with adhesive suspended particles (B) with a particle size of about 0.01 ~ 10 μ which show the same polarity as said colored particles (A) is suitable for said purpose. Such colored particle (A) consist of pigment particles coated with at least one member selected from the following group of resins (a), and can be obtained by subjecting a pigment and a resin to, for instance, the process of melting, kneading and then crushing or the process of kneading by the use of a solvent and spray-drying after removal of said solvent.

As the resin to be included in the group of resins (a), there are copolymer consisting of at least one monomer selected from the group consisting of styrene, chloromethylene, hydroxy styrene, vinyl benzoate, amino styrene, nitro styrene, dimethyl amino styrene and methyl styrene, dimethyl amino styrene and methyl styrene and at least one monomer selected from the group consisting of alkyl acrylate and alkyl methacrylate (wherein the ratio of said monomers can be determined optionally when said alkyl group has 1 ~ 6 carbon atoms, while in case said alkyl group has 7 ~ 12 carbon atoms, alkyl acrylate and/or alkyl methacrylate is to be less than 20 mol %), alkyl acrylate polymer or copolymer, alkyl methacrylate polymer or copolymer, alkyl acrylate~alkyl methacrylate copolymer (wherein their alkyl group has 1 ~ 6 carbon atoms), styrene~λ butadiene copolymer (wherein styrene is to be more than 70 mol %), polystyrene, polyvinyl toluene, phenol resin, epoxy resin, petroleum resin, rosin-denatured alkyd resin, polyamide and wax. As the resins illustrative of the group of resins (a), there are styrene~butyl methacrylate copolymer, styrene~isobutyl methacrylate copolymer, vinyl toluene~methyl acrylate copolymer, methyl methacrylate~ethyl methacrylate copolymer, butyl methacrylate~methyl methacrylate copolymer, amino styrene~methyl methacrylate copolymer, vinyl toluene~2-ethyl hexyl acrylate copolymer, styrene~2-ethyl hexyl methacrylate copolymer, chlorostyrene~hexyl methacrylate copolymer, vinyl toluene~2-ethyl hexyl methacrylate copolymer, vinyl toluene~lauryl methacrylate copolymer, carbana wax, paraffin wax, ethyl cellulose, etc. And, as the applicable commercial resins, there are Piccolatic A-50, Piccolatic A-75, Piccolatic D-75, Piccolatic D-100, Piccolatic D-125 (the foregoing are styrene resins), Piccotex 100, Piccotex 120, Piccolite S-85, Piccolite S-

100, Escolec 1071U, Escolec 1102U (the foregoing a e vinyl toluene resins) [the above enumerated are manufactures of ESSO Petroleum, Ltd.], PP-8500, PP-8100, PP-811, BP-700 (the foregoing phenol resins are manufactures of Gunei Kagaku, Ltd.), Pri-epor-PE 40, Pri-epor-PE 80, Pri-epor-PE 70 (the foregoing are manufactures of Dainippon Shikizai, Ltd.), Piccoflex 100, Piccodine 2025 (the foregoing are manufactures of ESSO Petroleum, Ltd.) [the above enumerated are epoxy resins], Piccovar 450, Piccovar 420-H, Inkovar 147 (the foregoing are petroleum resins manufactured by ESSO Petroleum, Ltd.), Pentlyn H, Pentlyn G, Betaprene H-100 (the foregoing are manufactures of Reich-Hord Co.), Stybelite, Pentaseit P406, Pentaseit P423 (the foregoing are manufactures of Harcules Corp.), Piccoplate (a manufacture of ESSO Petroleum, Ltd.) [the foregoing are rosin-denatured resins], Dital 6 (a manufacture of Dupon Corp.), DPA Polyamide (a manufacture of Johnson Corp.) [the foregoing are polyamide], Pliolite VTAC, Pliolite VTACL, Pliolite S-5A, Pliolite S-5B, Pliolite S-5D, Pliolite VT, Pliolite VTL, Pliolite AC (the foregoing are manufactures of Good Year Corp.), Pliolite ACL, and JSR 0060 (styrene~butadiene rubber).

As the pigment or dye for use in the present invention, those available on the market will do. There are, for instance, Carbon Black Mitsubishi No. 44, Carbon Black Mitsubishi No. MA-100 (the foregoing are manufactures of Mitsubishi Kasei, Ltd.), Printex G, Special Black-15 (a manufacture of Deggusa Co.), Statex, Peerles 155 (the foregoing are manufactures of Columbia Co.), Elftex 5 (a manufacture of Cabot Co.), Acetylene Black (a manufacture of Denki Kagaku, Ltd.), Cyanine Black (a manufacture of Sumitomo Kagaku, Ltd.), Special Black EB, Spirit Black S.B. (the foregoing are manufactures of Orient Kasei, Ltd.), Aniline Black (a manufacture of I.C.I. Co., England), Brilliant Carmine 6B (a manufacture of Sanyo Shikiso, Ltd.), Rhodamine B (a manufacture of Toyo Ink, Ltd.), Benzidine Yellow GNH (a manufacture of Sanyo Shikiso, Ltd.), Ultra Rose F (a manufacture of Toyo Ink, Ltd.), Cyanine Blue FG (a manufacture of Sanyo Shikiso, Ltd.), Phthalocyanine Green F7G (a manufacture of Dainichi Seika, Ltd.), Cyanine Blue LBG (a manufacture of Sumitomo Kagaku, Ltd.), Benzidine Yellow GR (a manufacture of Toyo Ink, Ltd.), Oil Blue, Alkali Blue (the foregoing are manufactures of Orient Kasei, Ltd.), Ultra Blue B (a manufacture of Toyo Ink, Ltd.), Spilon Yellow, Spilon Red (the foregoing are manufactures of Hodogaya Kagaku, Ltd.), Microlith Black-CT, Microlith Blue 40T, Microlith Green-CT, Microlith Yellow-20T, Microlith Red-RT (the foregoing are manufactures of CIBA, Ltd.), Reflex Blue-AG (a manufacture of Hochst Co., Ltd.), etc.

As the particles having the same composition as said colored particles (A), there are Lot 327/45 (a manufacture of Kalle Co., Ltd.) as a dry toner, Graph Fax Toner Powder No. 39-50 (a manufacture of Hunt Co., Ltd.), etc.

The appropriate compounding ratio of the pigment to a resin of the group of resins (a) by weight is in the range of about 1:1 ~ 10. The adhesive suspended particles (B) include (1) particles consisting of a resin belonging to the aforesaid group of resins (a), a resin belonging to the following group of resins (b) and a resin belonging to the following group of resins (c), (2) particles consisting of a resin belonging to the aforesaid group of resins (a) and a resin belonging to the following group of resins (b) and (3) particles consisting of a resin belonging to the following group of resins (b) and a resin belonging to the following group of resins (c), and the appropriate particle size is in the range of about 0.01 ~ 10 $\mu$. These particles can be obtained through the process of kneading the components together with an appropriate solvent and subsequently dispersing them by adding a carrier liquid thereto. By adding aromatic hydrocarbon and/or a plasticizer to the foregoing particles (1), (2) and (3), it is possible to enhance their adhesiveness.

It is desirable to make the adhesive suspended particles (B) further contain said pigment and/or dye to the extent of less than 20% by weight or thereabouts.

Besides, in the case of said particles (1), the appropriate compounding ratio of the resin belonging to the group of resins (a), the resin belonging to the group of resins (b) and the resin belonging to the group of resins (c) by weight is in the range of about 1:1 ~ 10:1 ~ 5, in the case of said particles (2), the appropriate compounding ratio of the resin belonging to the group of resins (a) and the resin belonging to the group of resins (b) by weight is in the range of about 1:1 ~ 10, and in the case of said particles (3), the appropriate compounding ratio of the resin belonging to the group of resins (b) and the resin belonging to the group of resins (c) by weight is in the range of about 1:0.1 ~ 1.

As the resins belonging to the group of resins (b), there are a copolymer consisting of at least one monomer selected from the group consisting of styrene, chlorostyrene, hydroxy styrene, vinyl benzoate, amino styrene, nitro styrene, dimethyl amino styrene and methyl styrene and at least one monomer selected from the group consisting of alkyl acryalte and alkyl methacrylate (wherein alkyl acrylate and/or alkyl methacrylate is more than 30 mol %, and alkyl group has 7 ~ 12 carbon atoms), alkyl acrylate polymer or copolymer, alkyl methacrylate~alkyl methacrylate copolymer (wherein alkyl group has more than 7 ~ 12 carbon atoms), styrene~butadiene copolymer (wherein styrene is less than 55 mol %), isobutylene~isoprene chlorinated copolymer and butyl rubber, and as the applicable commercial resins belonging to this group, there are Solpren 1205, Solpren 303, Solpren 235, Solpren 1204, Plioflex 3417, Plioflex 1502, SBR 1500, Butyl Rubber HT-1067, Butyl Rubber 68, ESSO Butyl 215, ESSO Vistaron 4504, ESSO Vistaron 3708, ESSO Vistanex LM and ESSO Vistanex MN.

As the resins belonging to the group of resins (c), there are copolymers consisting of at least one monomer selected from the group consisting of hydroxy alkyl acrylate, hydroxy alkyl methacrylate, epoxy alkyl acrylate, epoxy alkyl methacrylate (alkyl group in the foregoing has 1 ~ 4 carbon atoms), acryl nitrile, acrylic acid and methacrylic acid and at least one monomer selected from the group consisting of alkyl acrylate and alkyl methacrylate (alkyl group in the foregoing has 1 ~ 12 carbon atoms), such as methyl methacrylate~hydroxy ethyl methacrylate~butyl methacrylate copolymer, methyl methacrylate~acrylonitrile~butyl methacrylate copolymer butyl methacrylate~glycidyl methacrylate~acrylic acid~2-ethyl hexyl methacrylate copolymer, etc., and as the applicable commercial resins belonging to this group, there are Alon A-1001, Alon S-1511, Alon S-1510, Alon S-2040, Alon S-1606, Alon S-2302 and Alon S-1001.

As the aromatic hydrocarbons for use in preparing the adhesive suspended particles (B), there are Solvesso 100, Solvesso 150, Naphtha No. 1, Naphtha No. 5, Naphtha No. 6 (the foregoing are manufactures of ESSO Petroleum, Ltd.), Pegazol 1030, Pegazol 2130, Pegazol 3040, Pegazol AS-100, Pegazol ARO-40 (the foregoing are manufactures of Mobile Petroleum, Ltd.), Swazol 1500, Swazol 1800 (the foregoing are manufactures of Maruzen Petroleum, Ltd.), etc. As the plasticizer for use in the present invention, there are dimethyl phthalate, butyl phthalate, diethyl phthalate and tricresyl phosphate, and as the applicable commercial plasticizer, there are Adecacizer 0122, Adecacizer 0120, Adecacizer L-30, Adecacizer L-40, Drapex 7.7, Drapex 8.8, Epocizer P-202, Polycizer P-206 and Polycizer P-300 (the foregoing are manufactures of Adeca Argus Chemicals, Ltd.).

The adhesive suspended particles (B) may be further compounded with polyethylene, polypropylene, polyurethane or silicone oil to the extent of less than 10% by weight. Addition of polyethylene, polypropylene or polyurethane can improve the stability of dispersion, and addition of silicone oil can improve the strippability.

The carrier liquid for use in the present invention is to have electric resistance of $10^9$ Ω·cm or more and dielectric constant of less than 3, and as the applicable commercial carrier liquids, there are, for instance, Shell S.B.P, Shellzol, Isopar H, Isopar L, Isopar K, Isopar M, Isopar G, Isopar E, Naphtha No. 1, Naphtha No. 2, Naphtha No. 3, Naphtha No. 5, Naphtha No. 6, Solvesso 100, Solvesso 150 (the foregoing are manufacture of Shell Petroleum, Ltd.), Pegazol 1030, Pegazol 2130, Pegazol 2130-C, Pegazol 3040, Pegazol AS-100, Pegazol ARO-40 (the foregoing are manufactures of Mobil Petroleum Ltd.), etc.

A liquid developer under the present invention can be obtained by dispersing the foregoing colored particles (A) and adhesive suspended particles (B) in said carrier liquid. The ratio of said colored particles (A) to adhesive suspended particles (B) by weight is usually in the range of about 1:0.5 ~ 30. This developer may be further mixed with manganese naphthenate, cobalt naphthenate, nickel naphthenate, octope aluminum, aluminum stearate, etc.

In order to develop an electrostatic latent image by the use of a liquid developer under the present invention and subsequently transfer the thus developed image to an ordinary paper, plastic film, etc., it is possible to employ a bias jointly, but it suffices to resort to pressing alone. And the thus transferred image is possessed of an excellent resolving power. Besides, the liquid developer under the present invention can also display a superb effect with respect to stability of dispersion and stability of polarity. Such an effect is considered attributable to the facts that the colored particles (A) dispersed in the carrier liquid are substantially insoluble in said carrier liquid and possessed of properties of solid matter and the adhesive suspended particles (B) are possessed of such properties as fixing the image so that the colored particles forming the image are transferred en bloc, and the colored particles having the properties of solid matter can prevent the image from being crushed due to pressing at the time of transfer, rendering it possible to easily perform transfer of image of high resolving power.

Further particulars of the present invention will be given in the following by reference to some embodiments thereof.

DESCRIPTION OF THE PREFERRED EMBODIMENTS

Example 1

By kneading 50 g of Lot 327/45 as the dry toner (a manufacture of Kalle Co., Ltd.) with 250 g of Isopar L and dispersing by means of a ball-mill for 48 hours, colored particles (A) were prepared.

Meanwhile,

| | |
|---|---|
| Microlith Black-CT | 10 g |
| Reflex Blue-AG | 1.5 g |
| Pliolite VTAC | 200 g |
| Solpren 1205 | 100 g |
| Solvesso 150 | 300 g |
| Adecacizer 0122 | 30 g |

were kneaded for 30 minutes by means of a 3-roll mill, and 3000 g of Isopar-L was added to the kneaded mixture to be dispersed therein by a homodisper, whereby adhesive suspended particles (B) were obtained.

Next, 30 g of said particles (A), 400 g of particles (B) (containing isopar L) and 500 g of Isopar L were dispersed by means of a ball-mill for 24 hours to prepare a concentrated toner. By dispersing 1 part by weight of this concentrated toner in 3 parts by weight of Isopar L, a liquid developer was obtained.

When an electrostatic latent image formed on a photoconductive layer consisting mainly of polyvinyl carbazole was developed by applying this liquid developer and subsequently was lightly pressed with a rubber roller upon placing it over a commercial slick paper, the image was readily transferred and there was obtained a transferred image having a high resolving power. After the transfer, there was scarcely left a residual image, which was easy to remove. Besides, this developer displayed a excellent running ability.

Example 2

By kneading 50 g of Graphofax toner powder No. 39 with 250 g of Isopar M and dispersing by means of a ball-mill for 48 hours, colored particles (A) were prepared.

Meanwhile,

| | |
|---|---|
| Printex G | 5 g |
| Vinyl toluene~2-ethyl hexyl methacrylate (molar ratio=9:1) copolymer | 200 g |
| Solpren 1204 | 50 g |
| Swazol 1500 | 250 g |

were kneaded for 30 minutes by means of a 3-roll mill, and 3000 g of Isopar G was added to the kneaded mixture to be dispersed therein by a homodisper, whereby adhesive suspended particles (B) were obtained.

Next, 30 g of said particles (A), 500 g of particles (B) and 500 g of Isopar G were dispersed by means of a ball-mill for 24 hours to prepare a concentrated toner. By dispersing 1 part by weight of this concentrated toner in 3 parts by weight of Isopar G, a liquid developer was obtained. This developer demonstrated the same performances as that of Example 1.

Example 3

| | |
|---|---|
| Piccolatic A-75 | 100 g |
| Pliolite S-5A | 10 g |
| Peerles 155 | 20 g |
| Special Black EB | 5 g |

were melted and kneaded by means of a 2-roll mill for 8 hours (at a temperature of 120° ~ 130°C), and subsequently crushed into a dry powder having a particle size of about 1 ~ 5 μ, whereby colored particles (A) were prepared.

Meanwhile,

| | |
|---|---|
| Alon S-1511 | 50 g |
| Butyl Rubber HT-67 | 100 g |
| Plioflex 1502 | 100 g |
| Swazol 1800 | 200 g |
| Sun wax solution (1% petroleum solvent solution of polyethylene) | 300 g |
| Pegazol AS-100 | 3000 g |

were dispersed by means of a homodisper, whereby adhesive suspended particles (B) were obtained.

Next, 30 g of said particles (A) and 500 g of particles (B) were dispersed by means of a ball-mill for 24 hours to prepare a concentrated toner. By dispersing 1 part by weight of this concentrated toner in 3 parts by weight of Pegazol AS-100, a liquid developer was obtained. This developer demonstrated the same performances as that of Example 1.

Example 4

| | |
|---|---|
| Acetylene Black | 10 g |
| Alkali Blue | 2 g |
| Piccotex 120 | 100 g |

were melted and kneaded by means of a 2-roll mill for 3 hours, and subsequently crushed into a dry powder having a particle size of about 1 ~ 5 μ, whereby colored particles (A) were prepared.

Meanwhile,

| | |
|---|---|
| styrene~isobutyl methacrylate copolymer (molar ratio=5:5) | 100 g |
| Carbana wax | 2.5 g |
| S.B.R. 1500 | 50 g |
| dimethyl phthalate | 50 g |
| Isopar G | 100 g |

were kneaded by means of a 3-roll mill for 30 minutes, and 1500 g of Isopar G was added to the kneaded mixture to be dispersed therein by a homodisper, whereby adhesive suspended particles (B) were obtained.

Next, 50 g of said particles (A), 500 g of a dispersion of particles (B) and 500 g of Isopar G were dispersed by means of a ball-mill for 40 hours, whereby a concentrated toner was prepared. By dispersing 1 part by weight of this concentrated toner in 3 parts by weight of Isopar G, a liquid developer was obtained. This developer demonstrated the same performances as that of Example 1.

What is claimed is:

1. A wet developer for use in electrophotography comprising a carrier liquid having an electrical resistance of at least $10^4$ ohm cm. and a dielectric constant up to 3, there being two types of particles disposed therein, particles A and particles B;
   1. said particles A having a particle size of from 0.1 to 10 μ and comprising pigment particles coated with at least one member of the polymers selected from the group consisting of Group (a);
   2. said particles B being adhesive, having a particle size of from 0.01 to 10 μ and comprising at least one member selected from the group consisting of Resin 1, Resin 2 and Resin 3;

Resin 1 comprising a mixture containing at least one member of the polymers selected from the group consisting of Group (a), at least one member of the polymers selected from the group consisting of Group (b), and at least one member of the polymers selected from the group consisting of Group (c);

Resin 2 comprising a mixture containing at least one member of the polymers selected from the group consisting of Group (a), and at least one members of the polymers selected from the group consisting of Group (b); and Resin 3 comprising a mixture containing at least one member of the polymers selected from the group consisting of Group (b), and at least one member of the polymers selected from the group consisting of Group (c):

the said polymer Groups (a), (b), and (c) being defined as:

Polymer Group (a):

Polymers selected from the group consisting of:
   1. copolymers containing at least one monomer selected from the group consisting of styrene, chlorostyrene, hydroxystyrene, vinyl benzoate, aminostyrene, nitrostyrene, dimethyl aminostyrene and methylstyrene together with at least one monomer selected from the group consisting of:
      a. alkyl acrylates and methacrylates wherein the alkyl group contains 1 to 6 carbon atoms,
      b. alkyl acrylates and methacrylates wherein the alkyl group contains 7 to 12 carbon atoms (there being up to 20 mol % of such monomer in a copolymer),
   2. alkyl acrylate polymers and copolymers wherein the alkyl group contains 1 to 6 carbon atoms,
   3. alkyl methacrylate polymers and copolymers wherein the alkyl group contains 1 to 6 carbon atoms,
   4. alkyl acrylate-alkyl methacrylate copolymers wherein the alkyl group contains 1 to 6 carbon atoms,
   5. styrene-butadiene copolymers containing more than 70 mol % styrene,
   6. polystyrene,
   7. polyvinyl toluene,
   8. phenol resins,
   9. epoxy resins,
   10. petroleum resins
   11. rosin denatured alkyd resins,
   12. polyamides, and
   13. waxes:

Polymer Group (b):

Polymers selected from the group consisting of:
   1. copolymers selected from the group consisting of styrene, chlorostyrene, hydroxystyrene, vinyl benzoate, aminostyrene, nitrostyrene, dimethyl amino styrene, and methylstyrene, together with at least one monomer selected from the group consisting of:
      a. alkyl acrylates and methacrylates wherein the alkyl group contains from 7 to 12 carbon atoms (there being more than 30 mol % of said monomer in a copolymer),
   2. alkyl acrylate polymers and copolymers wherein the alkyl group contains 7 to 12 carbon atoms, 3. alkyl methacrylate polymers and copolymers wherein the alkyl group contains 7 to 12 carbon atoms,
4. styrene-butadiene copolymers containing up to 55 mol % of styrene,
5. chlorinated isobutylene-isoprene copolymers, and
6. butyl rubber:

Polymer Group (c):

Polymers selected from the group consisting of:

1. copolymers containing at least one monomer selected from the group consisting of:
   a. hydroxy and epoxy alkyl acrylates and methacrylates wherein the alkyl group contains from 1 to 4 carbon atoms, acrylonitrile, and acrylic and methacrylic acid together with at least one monomer selected from the group consisting of alkyl acrylates and methacrylates wherein the alkyl group contains from 1 to 12 carbon atoms.

2. A developer according to claim 1 containing only Resin 1, the weight ratio of Polymer Group (a) to Polymer Group (b) to Polymer Group (c) being from 1:1 – 10:1 – 5.

3. A developer according to claim 1 containing only Resin 2, the weight ratio of Polymer Group (a) to Polymer Group (b) being from 1:1 – 10.

4. A developer according to claim 1 containing only Resin 3, the weight ratio of Polymer Group (b) to Polymer Group (c) being from 1:1 – 10.

5. A developer according to claim 1 wherein the weight ratio of pigment to resin in Particles A is from 1:1 – 10.

6. A developer according to claim 1 wherein the weight ratio of Particles A to Particles B is from 1:0.5 – 30.

7. A developer according to claim 1 wherein Particles B contain up to 20% by weight of a pigment or a dye.

* * * * *